United States Patent [19]

Richter

[11] 3,938,737

[45] Feb. 17, 1976

[54] COUNTER FOR MEASURING APPARATUS SUCH AS A WATER METER OR THE LIKE

[75] Inventor: Hans Richter, Berlin, Germany

[73] Assignee: Siemens Aktiengesellschaft, Munich, Germany

[22] Filed: Jan. 30, 1975

[21] Appl. No.: 545,555

[30] Foreign Application Priority Data

Jan. 31, 1974 Germany ..... 2405145

[52] U.S. Cl. ..... 235/131 R; 235/58 P

[51] Int. Cl.[2] ..... G07B 15/00; G06C 25/02

[58] Field of Search ..... 235/58 P, 131 R, 144 TB; 101/75, 79, 85

[56] References Cited

UNITED STATES PATENTS 3,306,537 2/1967 Zeitlin ..... 235/131

FOREIGN PATENTS OR APPLICATIONS 926,049 3/1955 Germany ..... 131/

1,144,957 3/1963 Germany ..... 235/131

*Primary Examiner*—Edith Simmons Jackmon

*Attorney, Agent, or Firm*—Kenyon & Kenyon Reilly Carr & Chapin

[57] ABSTRACT

A counter for measuring apparatus such as a water meter or the like includes a first number wheel for a low decade; a drive shaft for driving the first number wheel; an additional number wheel for values of a lowest decade; a clutch coupling for coupling the additional number wheel to the drive shaft; and, a cam mechanism for aligning the number wheels. The cam mechanism includes a rotatable cam shaft for actuating a first pawl for engaging an alignment star of the first number wheel and an additional pawl for engaging an alignment star of the additional number wheel. The cam shaft is configured so as to first cause the additional pawl to engage the alignment star of the additional number wheel, and then, to cause the first pawl to engage the alignment star of the first number wheel when the cam shaft is rotated.

5 Claims, 1 Drawing Figure

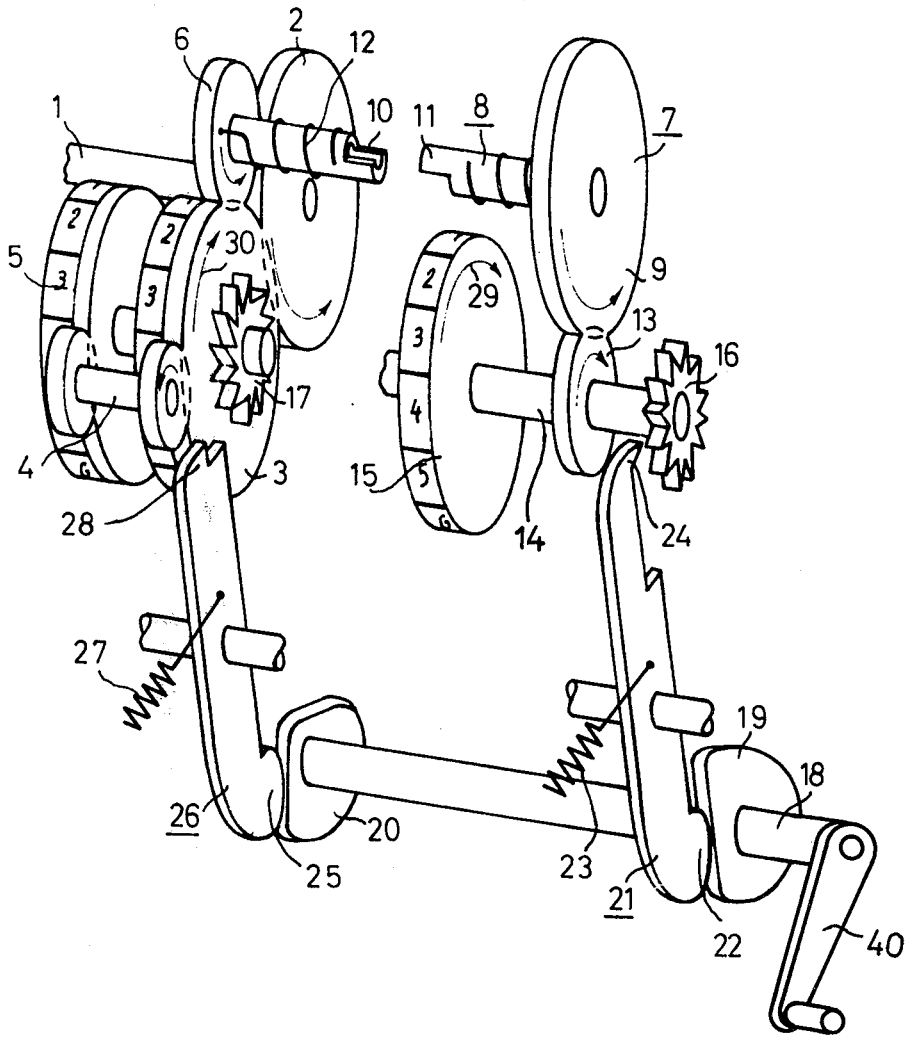
1
2
3
4
5
6
7
8
9
10
11
12
13
14
15
16
17
18
19
20
21
22
23
24
25
26
27
28
29
30
40

COUNTER FOR MEASURING APPARATUS SUCH AS A WATER METER OR THE LIKE

BACKGROUND OF THE INVENTION

The invention relates to a counter, particularly for liquid meters, which includes a first number wheel that can be driven by a drive shaft and is provided for values of a low decade. With this first number wheel are associated further number wheels for values of higher decades and an additional number wheel for values of a lowest decade. The driven first number wheel and the additional number wheel are each provided with an alignment star with which a corresponding pawl is brought into engagement for aligning the number wheel by a cam control mechanism when a handle is operated.

A counter of this kind is disclosed in German Patent 926,049 wherein, upon rotation of the drive shaft, only the number wheel for a low decade which can be driven by the drive shaft, and if applicable, further number wheels for values of higher decades are driven. An additional number wheel for values of a lowest decade remains in the rest position. Only when the drive shaft has come to a standstill (in the case that the known counter is connected with a liquid meter, this will be as a rule when a given quantity of liquid has been delivered), is a gear drive brought into engagement with the driven number wheel as well as with the additional number wheel through the operation of a handle. In addition, pawls drop into alignment stars of the driven number wheel and of the additional number wheel, this action being caused by a cam control mechanism when a handle is operated. Consequently, an alignment of the two number wheels is achieved in such a manner that they assume a position suitable for printing, which is such that after alignment, the individual numerals on the number wheels are in one line and therefore give a readable printout upon printing.

This known counter presents difficulties insofar as, after the driven number wheel is set by the drive shaft, a setting of the additional number wheel corresponding to the intermediate values at the driven number wheel must be accomplished in the alignment in a very short time by the operation of the handle. Large accelerations therefore occur in the alignment. In order to avoid damage to the mechanical parts, they must be made of relatively high-quality material, which causes a not inconsiderable extra expenditure.

Similar difficulties are encountered in the manufacture of another printing counter (German Patent 1,144,957) wherein an indicating number wheel that rotates the fastest sets a printing cylinder associated with it, which serves to print out the value of the integral numbers on the one hand accordingly, and on the other hand, drives an alignment mechanism which at first is idling along, at a fraction of the 1:10 transmission required overall. Although this counter is advantageous in view of the loading of a measuring device connected through the drive shaft, because it needs to supply only a relatively small torque for setting the counter due to the initially idling-along alignment mechanism, the problems already described above require relatively expensive materials also in this counter so that the manufacture also of this known counter becomes relatively expensive.

It is therefore an object of the invention to provide a counter wherein the alignment of the number wheels for the purpose of a clear readout of the counter setting is achieved also with regard to the values of the lowest decade notwithstanding the use of relatively inexpensive materials such as plastics.

SUMMARY OF THE INVENTION

To achieve the above object, the additional number wheel of a counter of the kind described in the foregoing is in driving connection with the drive shaft by means of a gear drive with a clutch interposed. When the handle is operated, a pawl first engages by means of a cam of the cam control mechanism with the alignment star of the additional number wheel and subsequently, controlled by a further cam of the cam control mechanism, a further pawl engages with the alignment star of the driven first number wheel.

In the counter according to the invention, the driven first number wheel and the additional number wheel are thus driven in parallel, as seen from the drive shaft, in that the drive shaft drives the first number wheel directly and drives the additional number wheel by means of a clutch and a gear train, the first number wheel being for values of a low decade and the additional number wheel for values of a lowest decade. In this way and with the clutch, it becomes possible to align the first number wheel which is driven and the additional number wheel separately from each other or sequentially. Because the additional number wheel co-rotates when the drive shaft rotates, no strong acceleration is exerted during the alignment on the parts of the gearing which are in direct connection with the additional number wheel. The additional number wheel, as also the first number wheel, need to be rotated in the one or the other direction by only maximally 18° during alignment in order to effect the alignment. The alignment therefore causes no great stresses of a mechanical kind, so that the counter accordng to the invention can be manufactured of plastic as far as all the number wheels and the gears connecting them are concerned. The problem of additional load of a measuring device connected to the counter through the drive shaft can be solved by optionally supporting the number wheels and gears on bearings.

The additional number wheel, which is driven with a transmission rate of 1:10 relative to the driven first number wheel, need not be connected directly with the drive shaft through the gear train and the clutch, but may also be connected with the driven first number wheel.

The clutch is preferably a jaw clutch and is advantageously provided with a spring which prevents a predetermined radial play of the clutch halves in drive direction and makes possible, after the alignment of the number wheel and after the readout of the values, the setting of the number wheel to the originally assumed position; the spring acts as a distance storage device to reproduce again adjusted values after the alignment.

Also the drive shaft is connected by means of a clutch with a connected measuring device so that an alignment of the driven first number wheel, which is directly connected with the drive shaft, can be performed without damage to the connected measuring device.

The counter according to the invention enables setting an additional number wheel with alignment for the values of a lowest decade, for example, tenths, without a requirement for expensive materials and demanding manufacture for the corresponding parts of the counter.

Although the invention is illustrated and described herein as a counter for measuring apparatus such as a water meter or the like, it is nevertheless not intended to be limited to the details shown, since various modifications may be made therein within the scope and the range of the claims. The invention, however, together with additional objects and advantages will be best understood from the following description and in connection with the accompanying drawing.

BRIEF DESCRIPTION OF THE DRAWING

The drawing is a perspective schematic diagram showing the counter according to the invention and its cam mechanism for aligning the pertinent number wheels.

DESCRIPTION OF THE PREFERRED EMBODIMNTS OF THE INVENTION

The counter shown contains a drive shaft 1, on which a gear 2 is fastened. The gear 2 is in engagement with a driveable number wheel 3 for values of a low decade. The driven number wheel 3 is connected through intermediate gears 4 with further number wheels for higher decades, of which only one further number wheel 5 is shown.

The driven number wheel 3 drives a gear 6 of a gear drive assembly 7. The gear 6 drives a further gear 9 through a clutch 8. The clutch 8 consists of two clutch halves 10 and 11 which mutually coact with radial play. A spring 12 assures that positive engagement of the clutch prevails if the gear 6 is driven in the direction of the arrow shown. The further gear 9 drives an additional gear 13 on a shaft 14, on which also an additional number wheel 15 for values of a lowest decade is attached. On the shaft 14 is also provided an alignment star 16. A further alignment star 17 is connected with the number wheel 3.

The counter further includes a cam shaft 18 which can be rotated by a handle 40 and on which a cam 19 and a further cam 20 are mounted; the two cams 19 and 20, together with the cam shaft 18, form a cam control mechanism. Against the cam 19 rests a pawl 21 with its one end 22, which is pressed against the cam 19 under the action of a spring 23. In the position of the cam 19 shown, the tip 24 of the pawl 21 is thereby held out of engagement with the alignment star 16.

Similarly, one end 25 of a further pawl 26 rests against the further cam 20 under the action of a spring 27. The tip 28 of the further cam 26 is in the rest position out of engagement with the further alignment star 17 of the number wheel 3.

If, by means of stopping the drive shaft 1, there occurs a setting of the number wheel 3, the further number wheels 5 and the additional number wheel 15, then, a rotation of the cam shaft 18 causes first, through cam 19, the tip 24 of the pawl 21 to be brought into engagement with the alignment star 16 whereby, depending on the position of the alignment star, the additional number wheel 15 is displaced in the direction of the arrow 29 with round-off upward or in the opposite direction, rounding-off downward. The cam shaft 18 can be rotated by operating a handle 40.

After the additional number wheel 15 is aligned, the further pawl 26, controlled by the further cam 20, is brought with its tip 28 into engagement with the alignment star 17 whereby an alignment of the number wheel 3 is achieved in a direction opposite to that indicated by arrow 30. This alignment is to the pertinent whole value; that is for example, in the case of a value 7.9, to the whole value 7, the value 9 having been fixed by the alignment star 16 on the additional number wheel 15. The displacement of the further number wheel 3 by the alignment star 17 is made possible by the clutch 8 with the spring 12 because a displacement of the number wheel 3 in the direction opposite to the arrow 30 is made possible by the play of the two clutch halves 10 and 11. With the alignment of the number wheel 3, the further number wheels 5 for values of higher decades are correspondingly aligned through the intermediate gear 4.

If the number wheels are each provided with ten printing types at their circumference, a perfect printout of the count of the counter can be made after the alignment. Instead of print type, the individual number wheels can also be provided, however, with magnetic or optical coding at their circumference or at the sides. It is also possible, of course, to drive with the number wheels always other number wheels, to permit not only a printout but also a readout in the form of coded data for the purpose of data processing or telemetering. With the number wheel can also be connected display wheels, to permit the operating personnel to read the counter.

What is claimed is:

1. A counter for measuring apparatus such as a water meter or the like comprising: a first number wheel for a low decade; a drive shaft for driving said first number wheel; an additional number wheel for values of a lowest decade; clutch-coupling means for clutch coupling said additional number wheel to said drive shaft; a first alignment star corresponding to said first number wheel and an additional alignment star corresponding to said additional number wheel; and, a cam mechanism for aligning said number wheels including: a rotatable cam shaft having a first cam disc and an additional cam disc mounted thereon; a first pawl mounted so as to be actuable by said first cam for engaging said first alignment star to align said first number wheel when said cam shaft is rotated; and, an additional pawl mounted so as to be actuable by said additional cam for engaging said additional alignment star to align said additional number wheel when said cam shaft is rotated; said cams being mounted on said cam shaft so as to first cause said additional pawl to engage said additional alignment star, and then, to cause said first pawl to engage said first alignment star when said cam shaft is rotated.

2. The counter of claim 1 comprising: further number wheels for respective higher decades, said further number wheels being mounted so as to be rotatable by the action of said drive shaft.

3. The counter of claim 2, said clutch-coupling means comprising: a rotatable clutch including a first clutch part and an additional clutch part; first gear means for gear connecting said first clutch part to said drive shaft; and, additional gear means for connecting said additional number wheel to said additional clutch part.

4. The counter of claim 3, said first gear means including gear means for gear connecting said first clutch part directly to said first number wheel whereby said additional number wheel is connected to said first number wheel.

5. The counter of claim 3, said first clutch part and said additional clutch part being configured to conjointly define a predetermined amount of radial play, said clutch including a spring connecting said clutch parts for holding said parts to preclude the same from moving relative to each other by the amount of said play when said clutch is rotated in the drive direction and for allowing said number wheels to be placed in their original position after said alignment.

* * * * *